United States Patent [19]

Gramling

[11] Patent Number: 4,751,870

[45] Date of Patent: Jun. 21, 1988

[54] SEALS FOR GAS AND OIL WELL SWABS

[76] Inventor: William D. Gramling, 5144 Newport Ave., Chevy Chase, Md. 20816

[21] Appl. No.: 832,443

[22] Filed: Feb. 24, 1986

[51] Int. Cl.[4] ..... F16J 1/04

[52] U.S. Cl. ..... 92/209; 92/242; 277/207 R

[58] Field of Search ..... 166/202; 277/212 C, 277/207 R, 208; 477/555 A, 240; 92/209, 242

[56] References Cited

U.S. PATENT DOCUMENTS 586,688 7/1897 Morrow ..... 92/240

3,994,208 11/1976 Boyer ..... 92/240 X 4,238,992 12/1980 Tuck, Jr. ..... 92/99 X 4,528,896 7/1985 Edwards ..... 92/242

*Primary Examiner*—William E. Wayner

*Attorney, Agent, or Firm*—Penrose Lucas Albright, Pravel, Gambrell, Hewitt, Kimball & Krieger

[57] ABSTRACT

Seal for maintaining gas-tight contact between casing wall and, particularly, automatic well swabs. The seal includes an upper portion containing a reinforcing tube and being minimally less in diameter than the casing interior, a tapering midsection and a lower skirt portion contacting the well casing. Also included is a secondary embodiment with an upper portion being substantially less in diameter than the casing interior and reinforcing ribs in the tapering midsection.

11 Claims, 1 Drawing Sheet

SEALS FOR GAS AND OIL WELL SWABS

FIELD OF THE INVENTION

Flexible seals for swabs used in raising liquid from an oil or gas well.

DESCRIPTION OF PRIOR ART

The U.S. Pat. No. 4,528,896, granted to Edwards on July 16, 1985 covers a seal that has undesirable characteristics. The constant thickness of the midsection creates inflexibility in the Edwards seal, allowing imperfections or joints in the casing to stop its downward travel. Also, the diameter of the upper portion, being substantially smaller than the casing, allows the swab to move excessively side-to-side on its descent, putting undue stress on the thinner-walled lower skirt portion. The present invention, in its preferred embodiment, includes an upper portion which is slightly smaller in diameter than the casing interior, giving the swab lateral stability. Also, the tapered midsection allows the lower skirt portion to negotiate the imperfections and joints in the casing without hanging.

SUMMARY OF THE INVENTION

The primary object of the present invention is to provide an effective sealing means for oil and gas well swabs while remaining sufficiently flexible to negotiate joints and rough areas in the casing. Another object is to give lateral stability to the swabs.

DESCRIPTION OF THE PREFERRED EMBODIMENTS

Figure 1:
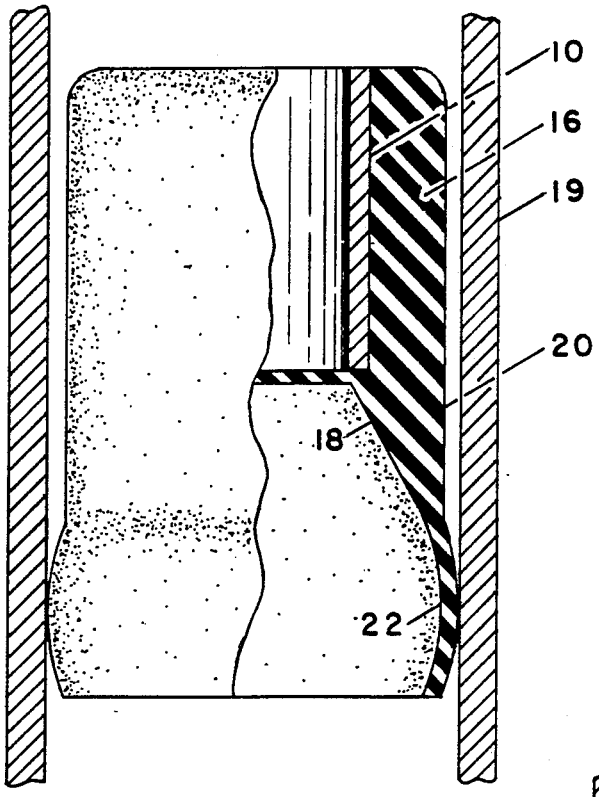
FIG. 1 shows the seal utilizing the thicker upper portion and the tapering midsection.

In actual use, two seals, made primarily of rubber or other resilient material, are normally used on the swab. They are stacked on an externally threaded tubular neck, separated by a spacer, and retained by an internally-threaded cap which is screwed down and tightened onto the top seal. Referring to FIG. 1, a rigid reinforcing tube 10 of metal or plastic is encircled by the thick upper portion 16. The exterior diameter of the upper portion 16 is slightly smaller than that of the well casing 19, allowing minimal lateral movement. This restriction of movement protects the lower skirt portion 22 which is of thinner rubber and prone to damage caused by the violent side-to-side movements of the swab on its rapid descent.

The tapered midsection, formed by the converging interior surface 18 and the exterior surface 20, gives the seal firm support at the bottom edge of the reinforcing tube 10, gradually becoming more flexible as the taper continues. At the juncture formed by the midsection and the lower skirt 22, the flexibility is at its greatest, allowing the skirt 22 to move freely in negotiating dents, salt rings or joints in the casing.

Figure 2:
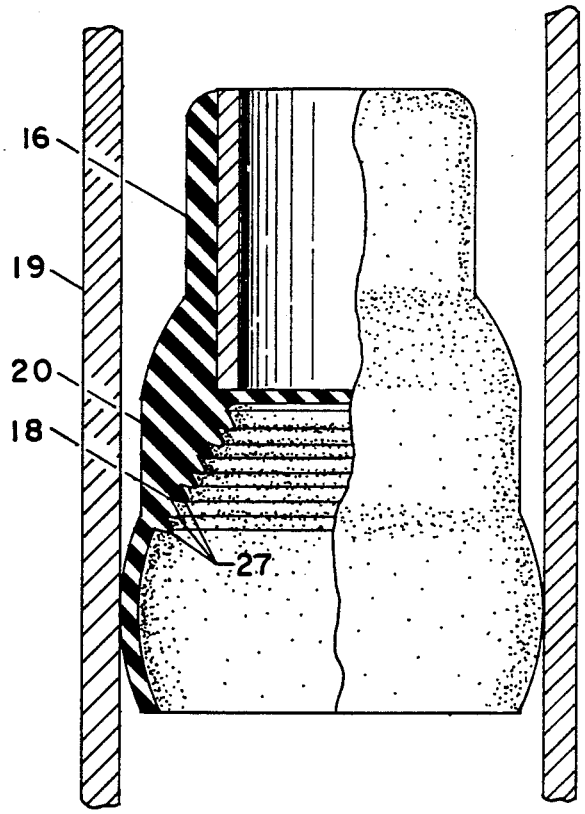
FIG. 2 illustrates the use of a narrower upper portion and ribbed, tapered midsection.

In FIG. 2, the upper portion 16 is shown as substantially narrower than the well casing 19. This configuration can be used if the swab itself is of a diameter that is close to that of the well casing, preventing the damaging side-to-side motion on descent.

If the pressure suddenly builds under the seal, it is possible for the tapered midsection to balloon out against the casing walls. This added friction could stop the upward movement of the swab. If pressure continues to build, a dangerous situation could occur. To prevent this, ribs 27 molded onto the interior midsection surface 18 resist this ballooning tendency while retaining the flexibility of the taper formed by the surfaces 18 and 20.

Having disclosed my invention, what I claim as new and to be secured by Letters Patent of the United States is:

1. For use in pumping liquids from oil wells and other like wells, a seal for an automatic swabbing device which is received in the well's casing or tubing and pumps liquids from the well, the seal comprising:

a reinforcing tube;

an elongated annular body composed of elastic material;

said body comprising;

an upper portion which receives and is secured to said reinforcing tube;

a tapered midsection portion, the inner surface of which generally coincides with a truncated cone and its outer surface being substantially parallel to said well casing's inner wall, said midsection portion being thicker at its upper aspect than at its lower aspect; and a skirt portion having an outer surface which bears against said well casing or tubing, said skirt portion extending downwardly, in a substantially mid-spherical configuration from said midsection portion, said midsection portion providing support for said skirt portion and increasing in flexibility from said upper aspect to said lower aspect in an arrangement so that said skirt portion is enabled to negotiate imperfections in said well casing or tubing.

2. A seal in accordance with claim 1 wherein said upper portion is thicker than the other said portions and has an outer diameter which is slightly less than the interior diameter of said casing or tubing.

3. A seal in accordance with claim 1 wherein the outer diameter of said upper portion is substantially less than the interior diameter of said casing or tubing at its upper aspect.

4. A seal in accordance with claim 1 where said midsection portion is provided with stiffening ribs.

5. A seal in accordance with claim 4 wherein said ribs are in the interior of said midsection portion.

6. A seal in accordance with claim 5 wherein said ribs are annular.

7. For use in pumping liquids from oil wells and other like wells, a seal for an automatic swabbing device which is received in the well's casing or tubing and pumps liquids from the well, the seal comprising:

a reinforcing tube;

an elongated annular body composed of elastic material;

said body comprising;

an upper portion which receives and is secured to said reinforcing tube;

a tapered midsection portion, the inner surface of which generally coincides with a truncated cone, said midsection portion being thicker at its upper aspect than at its lower aspect; and a skirt portion having an outer surface which sealingly engages said well casing or tubing, said skirt portion being supported by and extending downwardly from said midsection portion, said latter portion increasing in flexibility while decreasing in wall thickness from said upper aspect to said lower aspect and being constructed and arranged so that said skirt portion is enabled to negotiate imperfections in said well casing or tubing while maintaining a sealing engagement therewith.

8. A seal in accordance with claim 7 wherein the outer diameter of said upper portion is substantially less than the interior diameter of said casing or tubing at its upper aspect, said upper portion's lower aspect's outer diameter being slightly less than the interior diameter of said casing or tubing.

9. A seal in accordance with claim 7 where said midsection portion is provided with stiffening ribs.

10. A seal in accordance with claim 9 wherein said ribs are in the interior of said midsection portion.

11. A seal in accordance with claim 10 wherein said ribs are annular.

* * * * *